US008893539B2

(12) United States Patent
Valle

(10) Patent No.: US 8,893,539 B2
(45) Date of Patent: Nov. 25, 2014

(54) METHOD OF PROFILING A TUBE OF GIVEN LENGTH

(75) Inventor: Vittorio Renato Valle, Turin (IT)

(73) Assignee: Vavit S.R.L., Rivoli (IT)

( * ) Notice: Subject to any disclaimer, the term of this patent is extended or adjusted under 35 U.S.C. 154(b) by 812 days.

(21) Appl. No.: 13/057,125

(22) PCT Filed: Aug. 1, 2008

(86) PCT No.: PCT/IT2008/000529
§ 371 (c)(1),
(2), (4) Date: Apr. 22, 2011

(87) PCT Pub. No.: WO2010/013273
PCT Pub. Date: Feb. 4, 2010

(65) Prior Publication Data

US 2011/0277529 A1 Nov. 17, 2011

(51) Int. Cl.

| | |
|---|---|
| ***B21B 13/10*** | (2006.01) |
| ***B21B 39/20*** | (2006.01) |
| ***B21B 17/10*** | (2006.01) |
| ***B21C 37/20*** | (2006.01) |
| ***B21C 37/15*** | (2006.01) |
| ***B21D 5/12*** | (2006.01) |

(52) U.S. Cl.
CPC ..... *B21C 37/155* (2013.01); *B12D 15/02* (2013.01); *B21C 37/202* (2013.01); *B21D 5/12* (2013.01); *B21C 37/207* (2013.01)
USPC ..... 72/225; 72/208; 72/250; 72/252

(58) Field of Classification Search
USPC ..... 72/190, 250, 252.5, 225, 224, 64, 335, 72/370.23, 370.24, 370.26, 78, 95, 208, 72/246, 252, 248, 249
See application file for complete search history.

(56) References Cited

U.S. PATENT DOCUMENTS

| | | | | |
|---|---|---|---|---|
| 8,020,422 | B2 * | 9/2011 | Kunimoto et al. | 72/208 |
| 2010/0000073 | A1 * | 1/2010 | Steinhoff et al. | 29/592 |

FOREIGN PATENT DOCUMENTS

| | | |
|---|---|---|
| JP | 50-077263 | 6/1975 |
| JP | 59-092106 | 5/1984 |
| JP | 3094941 | 4/1991 |
| JP | H04-123710 | 11/1992 |
| JP | 10230325 | 9/1998 |
| JP | 10314837 | 12/1998 |
| JP | 2008043959 | 8/2008 |
| WO | 9620808 | 7/1996 |
| WO | 0064606 | 11/2000 |
| WO | 2008022626 | 2/2008 |

OTHER PUBLICATIONS

JP2008-043959 Machine Translation.*
International Search Report for International Application No. PCT/IT2008/000529, European Patent Office, May 6, 2009, pp. 5.
Japanese Office Action for Japanese patent application No. 2011-520659, mailed on Jul. 24, 2012, 7 pages.

* cited by examiner

*Primary Examiner* — Shelley Self
*Assistant Examiner* — Mohammad I Yusuf
(74) *Attorney, Agent, or Firm* — Lane Powell PC; Bryan A. Santarelli

(57) ABSTRACT

An embodiment of a method for profiling a tube of given length, whereby, after inserting the tube between at least one pair of rolls having respective coplanar, parallel axes of rotation crosswise to the tube, the rolls are moved onto the tube and pressed gradually against the tube, which, at the same time, is moved axially back and forth.

11 Claims, 3 Drawing Sheets

Fig.8
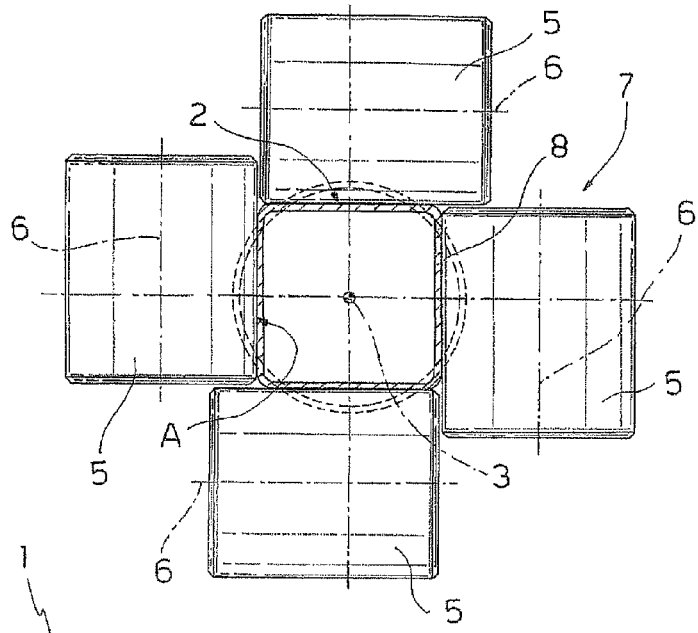
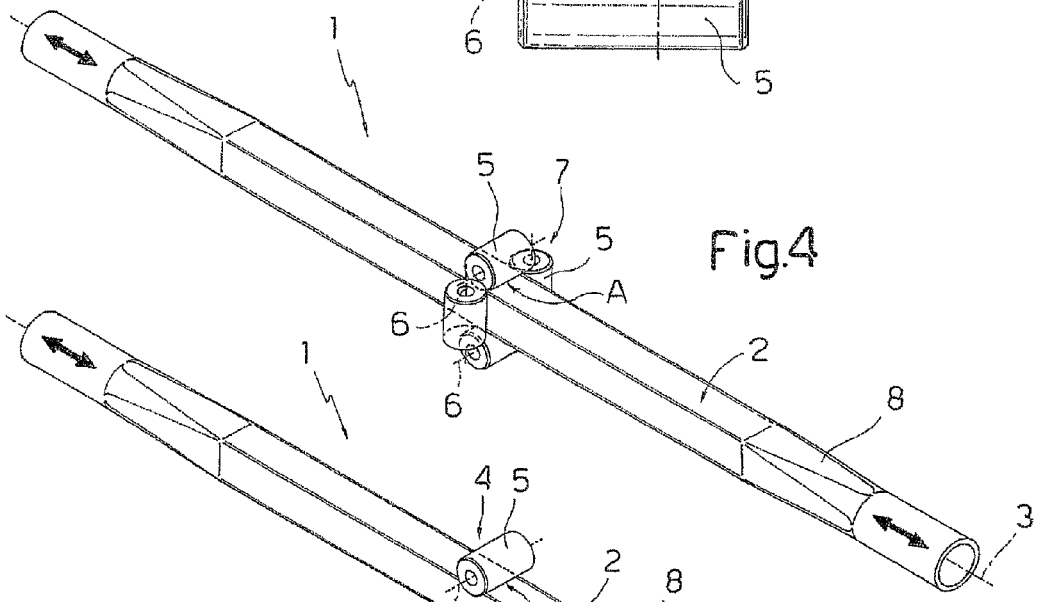
Fig.4
Fig.5

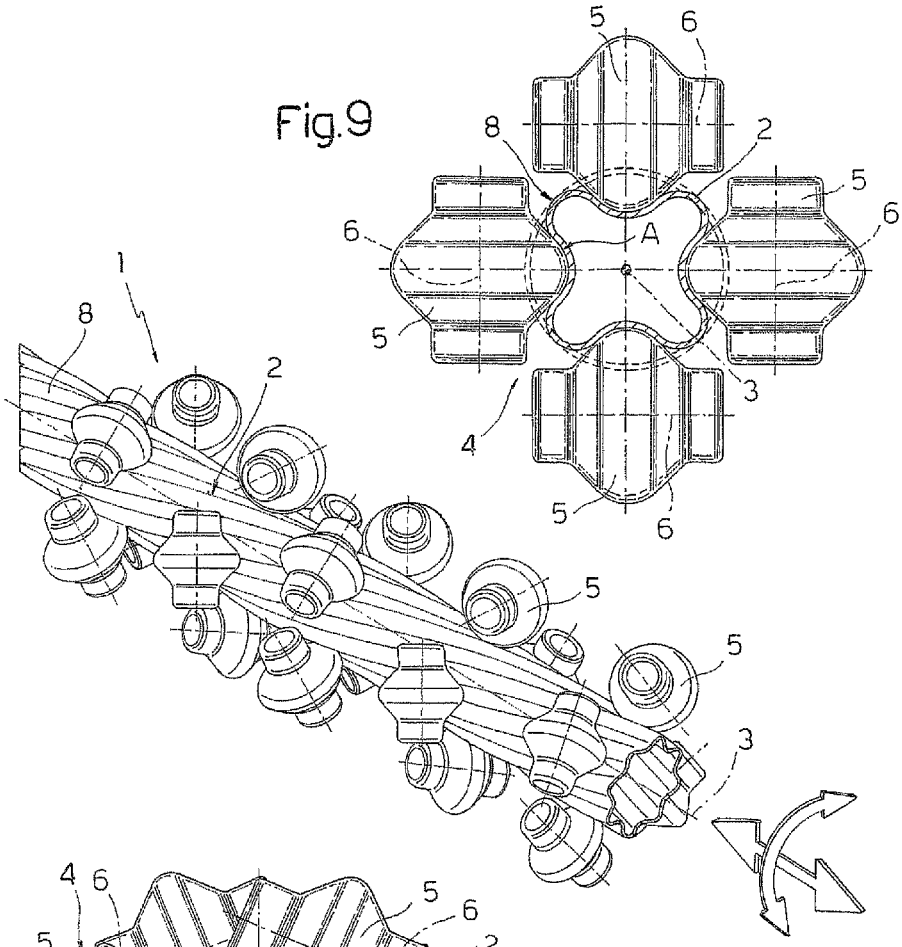
Fig.9
Fig.6
1
2
3
4
5
6
8
A
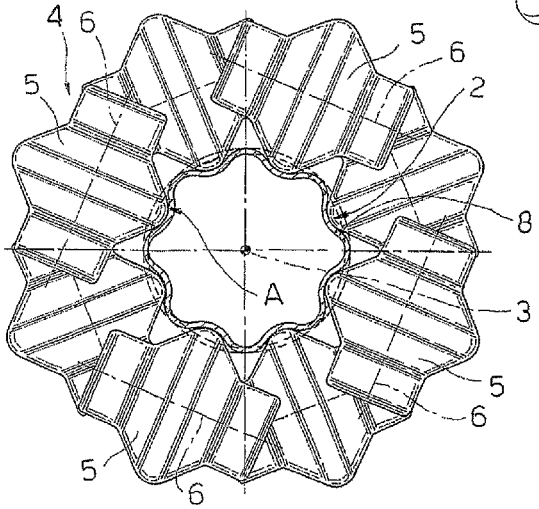
Fig.7
2
3
4
5
6
8
A

METHOD OF PROFILING A TUBE OF GIVEN LENGTH

PRIORITY CLAIM

The present application is a national phase application filed pursuant to 35 USC §371 of International Patent Application Ser. No. PCT/IT2008/000529, filed Aug. 1, 2008; which application is incorporated herein by reference in its entirety.

TECHNICAL FIELD

An embodiment relates to a method of profiling a tube of given length, in particular a metal tube obtained by cutting a tube of indefinite length transversely at the end of a continuous production process.

BACKGROUND

To profile metal tubes of given length and cross section, various methods are used to convert the original cross section of the tube to a different, e.g., circular, square, rectangular, lobed, star-shaped, cross section, etc.

One of the most common methods is to feed the tube through a number of forming dies aligned in a given travelling direction of the tube and each comprising a number of rolls arranged to define a passage for the tube.

The cross sections of the successive passages differ from one another, and increasingly approximate, in the travelling direction of the tube, the final cross section of the tube, so that the tube, as it proceeds in the travelling direction, is gradually deformed from its original to the desired final cross section.

The above method produces profiles of fairly good quality, but has several drawbacks which may seriously impair output.

A first of these lies in anomalous deformation of the leading end portion of the tube when the tube is inserted between the rolls of the dies. As a result, the end portion typically must be removed at the end of the profiling process, thus resulting in additional cost in terms of both equipment and waste.

Another drawback of the above method derives from the fact that the forming dies are normally designed for a given tube size and a given final cross section, so that, for each different starting size of the tube and/or each different final cross section, all or some of the dies typically must be changed, thus incurring additional cost in terms of production holdups and the high cost of the equipment required.

To eliminate the latter drawback, which may get worse as the tube gets bigger, a different method has been proposed whereby all the dies, or at least all those interposed between an initial rough die and a final finish die, are replaced by a number of pairs of opposite rolls movable, with respect to each other and within a given range, in a radial direction with respect to the tube axis.

Though more flexible, by being fairly adaptable to the size and shape of the tubes, this solution fails to solve the first of the drawbacks described above, relative to anomalous deformation of the leading end of the tube.

A solution to this problem is proposed by WO-A-2008/022626, which is incorporated by reference and which teaches to feed a tube between a pair of spaced apart rolls, which are then closed onto an intermediate portion of the tube and set at a distance to one another less than the external diameter of the tube, which is heated in order to allow radial penetration of the rolls. The tube is then reciprocated between the rolls to obtain deformation of the aforementioned intermediate portion of the tube. The final shape of the tube is obtained by adjusting the gap between the rolls in a stepped manner.

The above solution suffers from a number of drawbacks mainly because the radial load applied by the rolls to the tube at any step-adjustment of the gap is a static radial load, which would involve ovalization of the tube should the tube not be heated. Moreover, the axial forces necessary to start moving the tube axially are so high that the transverse stability of the rolls is typically always put in jeopardy.

SUMMARY

An embodiment is a method of profiling a tube of given length, which is cheap and easy to implement and, at the same time, provides for eliminating the aforementioned drawbacks.

BRIEF DESCRIPTION OF THE DRAWINGS

A number of non-limiting embodiments will be described by way of example with reference to the accompanying drawings, in which:

FIGS. 2 to 6 show schematic views in perspective of operation of respective variations of the FIG. 1 unit;

FIG. 7 shows a larger-scale cross section of the FIG. 6 unit;

FIGS. 8 and 9 are similar to FIG. 7 and show cross sections of respective variations of FIG. 1.

DETAILED DESCRIPTION

Figure 1:
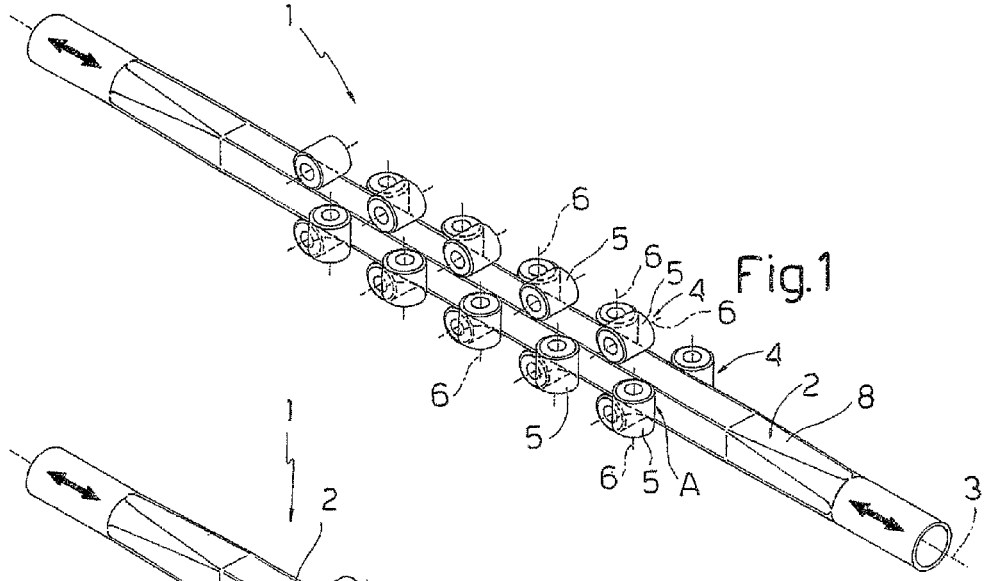
FIG. 1 shows a schematic view in perspective of operation of an embodiment of a unit for profiling a tube of given length and implementing a method according to an embodiment.

Number 1 in FIG. 1 indicates as a whole an embodiment of a unit for profiling a tube 2 of given length L.

By way of example, the tube 2 in FIG. 1 has an original circular cross section coaxial with a longitudinal axis 3 and to be converted by an embodiment of a profiling method into a substantially square cross section.

Unit 1 comprises a number of pairs 4 of opposite rolls 5 equally spaced along axis 3 and on a portion of tube 2 shorter in length than length L.

Rolls 5 in each pair 4 are approximately identical, are located on opposite sides of axis 3, rotate about respective parallel, coplanar axes 6 crosswise to axis 3, each have a cylindrical work surface, and are each of a length at least equal to the side of the desired final square cross section.

Pairs 4 of rolls 5 are arranged in alternate positions offset angularly by 90 degrees about axis 3. That is to say, the work surfaces of rolls 5 in each pair 4 face respective portions of tube 2 at 90 degrees to the portions facing the work surfaces of each of the adjacent pairs 4.

Rolls 5 in each pair 4 are fitted adjustably to respective supports (not shown) so as to move gradually, with respect to each other and radially with respect to axis 3, between an open position, in which the respective work surfaces are spaced apart by a distance d, measured along the center distance, equal to or greater than the initial diameter of tube 2, and a closed position, in which distance d between the respective work surfaces of rolls 5 equals the length of the side of the desired square cross section.

Rolls 5 are moved radially by actuating devices (not shown) controlled by an electronic central control unit (not shown), and which may be defined, for example, by known mechanical jacks, known hydraulic cylinders, or other similar actuating systems of known design and operation and therefore not described in detail.

Rolls 5 in pairs 4 are powered by reversible electric or hydraulic motors (not shown) to rotate in both directions about respective axes 6. In a variation, some rolls 5 are powered, and some idle.

In actual use, at the start of the profiling process, rolls 5 in each pair 4 are set to the open position to define, as a whole, a through channel wider than the original circular cross section of tube 2.

Tube 2 is then positioned between rolls 5, with axis 3 of the tube substantially crosswise to axes 6, and with the cylindrical lateral wall 8 of the tube substantially equidistant from the work surfaces of rolls 5.

Once tube 2 is positioned, rolls 5 in each pair 4 are moved, radially with respect to axis 3, up to tube 2 and are rotated in opposite directions about respective axes 6.

On reaching lateral wall 8, rolls 5 begin compressing and deforming lateral wall 8 and, at the same time, push tube 2 axially in the same direction as the rotation direction of rolls 5 at the point of tangency. When the trailing end of tube 2, in the travelling direction of tube 2, reaches the rear pair 4, rotation of rolls 5 is inverted so tube 2 moves axially in the opposite direction.

As tube 2 moves back and forth as described above, rolls 5 in all of pairs 4 are gradually pressed simultaneously against lateral wall 8, so the combined action of the pressure of rolls 5 and the axial movement of the tube produces gradual, even deformation of lateral wall 8.

Profiling terminates as rolls 5 reach the closed position, in which the cross section of the passage defined by pairs 4 as a whole matches the desired final cross section of tube 2 and the whole of tube 2 is equally deformed.

At this point, tube 2 may be removed from rolls 5, which are then reset to the open position to receive the next tube 2. Alternatively, rolls 5 may be reset to the open position before tube 2 is removed, in this case manually.

In connection with the above, it is pointed out that the initial position of tube 2 is in no way compulsory, and tube 2 need not be positioned with its central portion at pairs 4, as in the example described. For example, if tube 2 is positioned initially with an end portion facing pairs 4, the first axial movement of tube 2 need simply be modified so that deformation by rolls 5 is "distributed" along the whole length of tube 2.

In this connection, it is pointed out that, unlike conventional profiling methods, an embodiment of the method described also has the advantage of enabling profiling of a portion of tube 2 of any length, equal to or less than length L, or of two or more non-contiguous portions of tube 2, by programming the central control unit (not shown) to appropriately control rotation of rolls 5 and the radial opening and closing movement of pairs 4. In which case, rolls 5 are restored to the open position before tube 2 is removed from rolls 5 at the end of the profiling process.

It is pointed out that in an embodiment, the method described above relative to unit 1 in FIG. 1 applies regardless of the number and arrangement of rolls 5.

Figure 2:
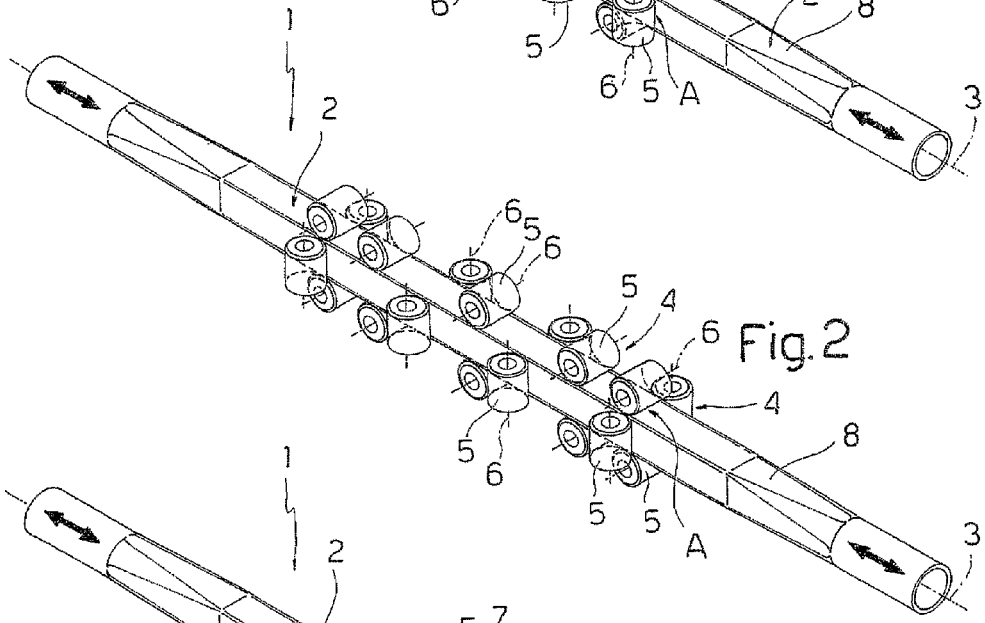

For example, in the FIG. 2 variation, unit 1 comprises, in addition to pairs 4 as in FIG. 1, two forming dies 7 located at respective ends of pairs 4 and each comprising four identical coplanar rolls 5 arranged in two opposite pairs to form a passage A coaxial with axis 3.

Figure 3:
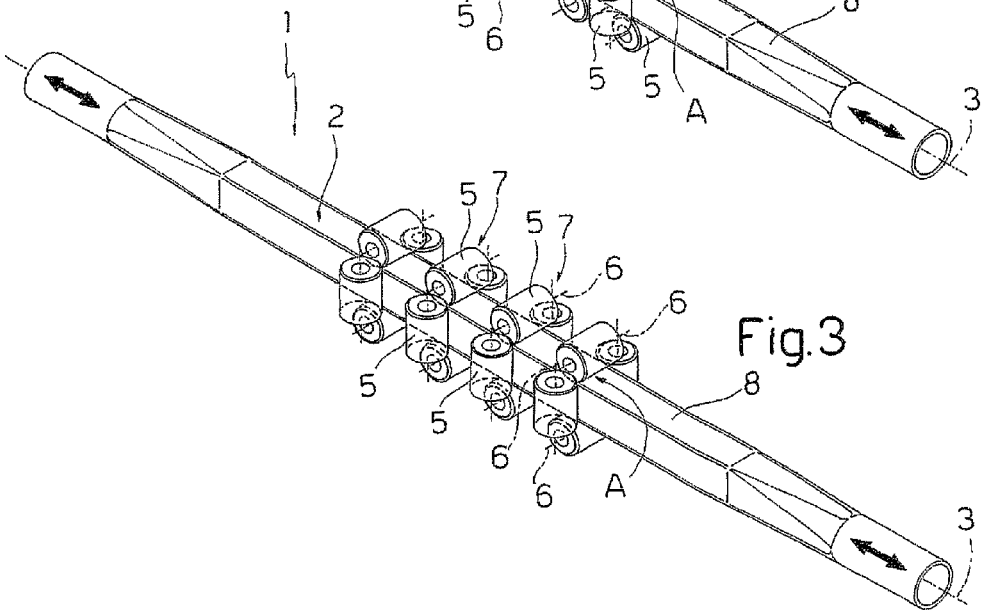

In the FIGS. 3 and 4 variations, unit 1 comprises a number of dies 7 aligned along axis 3, and one die 7, respectively.

For maximum versatility of unit 1, dies 7 may be so-called "all-purpose" dies, i.e., in which rolls 5 may assume various closed positions, each corresponding to a given size of the desired final cross section. Like pairs 4, rolls 5 of each die 7 are fitted to a support (not shown) and are radially adjustable with respect to axis 3.

In the FIG. 5 variation, unit 1 comprises one pair 4 of rolls 5. This embodiment has a major advantage of being simple, compact, and cheap, but, to work the whole outer surface of tube 2, calls for profiling in stages, and rotating tube 2 about axis 3 between one stage and the next to selectively position contiguous portions of lateral wall 8 facing the work surfaces of rolls 5.

It is also stressed that in an embodiment, the method described relative to unit 1 in FIG. 1 also applies regardless of the shape of rolls 5 and/or of dies 7, i.e. regardless of the shape of the desired final cross section.

For example, as shown in FIGS. 7 and 9, final lobed cross sections of various types may be obtained using appropriately shaped rolls 5 offset appropriately about axis 3.

Finally, FIG. 6 shows a variation of an embodiment of the method described above, by which to obtain a tube 2 with a helical lobed cross section which is impractical or impossible using known conventional methods.

In this case, rolls 5 have respective axes 6 sloping with respect to axis 3 of tube 2, so that tube 2 is rotated back and forth approximately simultaneously and in time with its back and forth axial movement.

In this connection, it may be important to note that, in a variation, rolls 5 may all be idle, and tube 2 may be moved axially and rotated back and forth by means of one or more external actuating devices (not shown) controlled by the electronic central control unit (not shown).

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

The invention claimed is:

1. A method of profiling a tube having a given length, a longitudinal axis, and a lateral wall substantially coaxial with the longitudinal axis, the method comprising:

arranging at least one pair of opposite rolls, having respective axes of rotation, to define a passage for loosely receiving the tube;

inserting the tube inside the passage, with the longitudinal axis of the tube substantially crosswise to said axes of rotation;

moving the rolls radially with respect to said longitudinal axis into contact with said lateral wall, and then pressing the rolls gradually against the lateral wall; and moving the tube axially back and forth; and simultaneously imparting said radial movement of the rolls and said axial back and forth movement of the tube.

2. A method as claimed in claim 1, and further comprising rotating the tube back and forth about its longitudinal axis; the rotating movement and the axial movement being combined to produce a helical movement.

3. A method as claimed in claim 2, wherein said rotating movement is imparted simultaneously and in time with the axial back and forth movement.

4. A method as claimed in claim 1, wherein a number of pairs of rolls are provided, and are offset with respect to one another by a given angle about the longitudinal axis of the tube; the same radial movement being imparted to the rolls in all the pairs.

5. A method as claimed in claim 4, wherein at least two pairs of rolls are arranged to define a forming die.

6. A method as claimed in claim 1, wherein the rolls are powered; the tube being moved axially by the rolls, and being moved axially back and forth by inverting rotation of the rolls.

7. A method as claimed in claim 1, and further comprising withdrawing the rolls radially from the tube to re-form said passage, and at least partly removing the profiled tube from the passage.

8. A method as claimed in claim 1, wherein said axial back and forth movement is shorter in length than the length of the tube, and involves a given portion of the tube.

9. A method as claimed in claim 8, wherein said given portion is a central portion.

10. A method as claimed in claim 8, wherein said given portion comprises at least two separate sub-portions in series.

11. A method as claimed in claim 1, wherein the radial movement of the rolls and the axial movement of the tube are electronically controlled.

* * * * *